US005328382A

United States Patent [19]

Pawlicki

[11] Patent Number: 5,328,382

[45] Date of Patent: Jul. 12, 1994

[54] ELECTRICAL CONNECTOR WITH EXTERNAL SEAL AND INTERNAL TERMINAL RETAINING MEANS

[75] Inventor: Jeffrey J. Pawlicki, Downers Grove, Ill.

[73] Assignee: Molex Incorporated, Lisle, Ill.

[21] Appl. No.: 47,593

[22] Filed: Apr. 13, 1993

[51] Int. Cl.[5] ..... H01R 13/52

[52] U.S. Cl. ..... 439/273; 439/595

[58] Field of Search ..... 439/271-283, 439/595, 599, 600

[56] References Cited

U.S. PATENT DOCUMENTS

| | | | |
|---|---|---|---|
| 3,601,760 | 8/1971 | Cairns | 339/59 |
| 3,937,545 | 2/1976 | Cairns et al. | 339/60 R |
| 4,479,691 | 10/1984 | Smith, Jr. | 439/595 |
| 4,557,542 | 12/1985 | Coller et al. | 339/59 M |
| 4,714,437 | 12/1987 | Dyki | 439/595 |
| 4,749,372 | 6/1988 | Betsui | 439/587 |
| 4,826,482 | 5/1989 | Sian et al. | 439/595 |
| 4,944,695 | 7/1990 | Tsuji et al. | 439/595 |
| 4,963,103 | 10/1990 | Fink et al. | 439/352 |
| 5,127,854 | 7/1992 | Fujitani et al. | 439/595 |

*Primary Examiner*—David L. Pirlot
*Attorney, Agent, or Firm*—A. A. Tirva

[57] ABSTRACT

An electrical connector includes a dielectric housing having passageways extending therethrough. Electrical terminals are positioned in the passageways. Resilient latch arms are provided by the housing and include projections for engaging the terminals in the passageways. The housing has receptacles adjacent the resilient latch arms. A seal is located in a recess about the outside of the housing. A terminal locking and seal retaining member includes lock arms insertable into the receptacles in the housing for limiting movement of the resilient latch arms and thereby maintaining the projections in latching engagement with the terminals. The member also includes a peripheral flange for engaging the seal and maintaining the seal in the recess about the housing.

4 Claims, 2 Drawing Sheets

ELECTRICAL CONNECTOR WITH EXTERNAL SEAL AND INTERNAL TERMINAL RETAINING MEANS

FIELD OF THE INVENTION

This invention generally relates to the art of electrical connectors and, particularly, to an electrical connector which has an external seal and an internal terminal retention system, and embodying a unique dual-function locking means for both.

BACKGROUND OF THE INVENTION

Electrical connectors typically include an outer dielectric housing surrounding an array of terminals to insulate the terminals and prevent the terminals from contacting any other electrical apparatus. The terminals often are of the axial connectable type in which male and female terminals of complementary connectors are axially mated in order to make an electrical connection. To effect axial connection of the terminals, a mating force must be applied to the terminals and, because the terminals are encased within their respective connector housings, the terminals may become detached from their respective housings unless they are properly retained therewithin.

A variety of approaches have been employed for retaining terminals within connector housings. Generally, two approaches are most common. First, the terminals may be inserted into their respective housings and retained therein by appropriate locking means with no further steps required. These types of connectors often are undesirable because of the rather high insertion forces required to insert the terminals into their respective housings. If excessive insertion forces are compromised, the retention forces of the terminals may be inadequate.

A second approach which has been used to achieve both low insertion forces for inserting the terminals into their respective housings, while at the same time providing a connector assembly in which high forces are required to separate the terminals from their respective housings, is to use multiple component housings in which a separate spacer or locking device is employed to retain the terminals within their respective housings after the terminals are inserted into the housings with low insertion forces.

Generally, a typical electrical connector employing the second approach, above, includes a dielectric housing having passages for receiving the terminals. Resilient latches are provided by the housing, and the latches include projections for engaging the terminals in the passages. The housing has receptacles adjacent the resilient latches, and a lock means is inserted into the receptacles for limiting movement of the resilient latches and thereby maintaining the projections in latching engagement with the terminals.

As stated, the second approach requires multiple component housings. This may be undesirable particularly when the connectors embody other features which may require still further components. For instance, the connectors may have external environmental seals, whereby one connector is inserted into a complementary connector, with a seal ring or the like thereabout. Often, still additional components are required to maintain the seals in their proper positions. The overall result is that the electrical connectors become unduly complicated and are not cost effective because of the number of components required to make up the entire connector assembly.

This invention is directed to solving the above problems by providing a unique, simple electrical connector which utilizes a locking member which performs the multiple functions of (a) defining a mating face of the connector, (b) locking the terminals within the connector housing and (c) retaining a seal about the periphery of the housing, all functions being accomplished by a single easily fabricated component.

SUMMARY OF THE INVENTION

An object, therefore, of the invention is to provide a new and improved electrical connector of the character described.

In the exemplary embodiment of the invention, the electrical connector includes a dielectric housing having passageway means extending therethrough. Electrical terminal means are positioned in the passageway means. Resilient latch means are provided by the housing and include projection means for engaging the terminal means in the passageway means. The housing has receptacle means adjacent the resilient latch means, and lock means are insertable into the receptacle means for limiting movement of the resilient latch means and thereby maintaining the projection means in latching engagement with the terminal means.

The invention contemplates the provision of seal means located in recess means on the housing. The lock means is configured for maintaining the seal means in the recess means, whereby the lock means performs the dual function of maintaining the projection means in latching engagement with the terminal means and also maintaining the seal means in the recess means.

Still further, the lock means include a face plate portion to perform a further function of defining a mating face of the connector. The face plate portion includes aperture means in registry with the passageway means in the housing.

As disclosed herein, the resilient latch means are located inside the housing and the seal means are located outside the housing. Specifically, the seal means are located in a recess surrounding the housing. The lock means is configured to include the face plate portion defining the mating face of the connector, along with a peripheral flange extending substantially about the housing and engageable with the seal means, as well as arm means projecting from the face plate portion into the housing for limiting movement of the resilient latch means.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
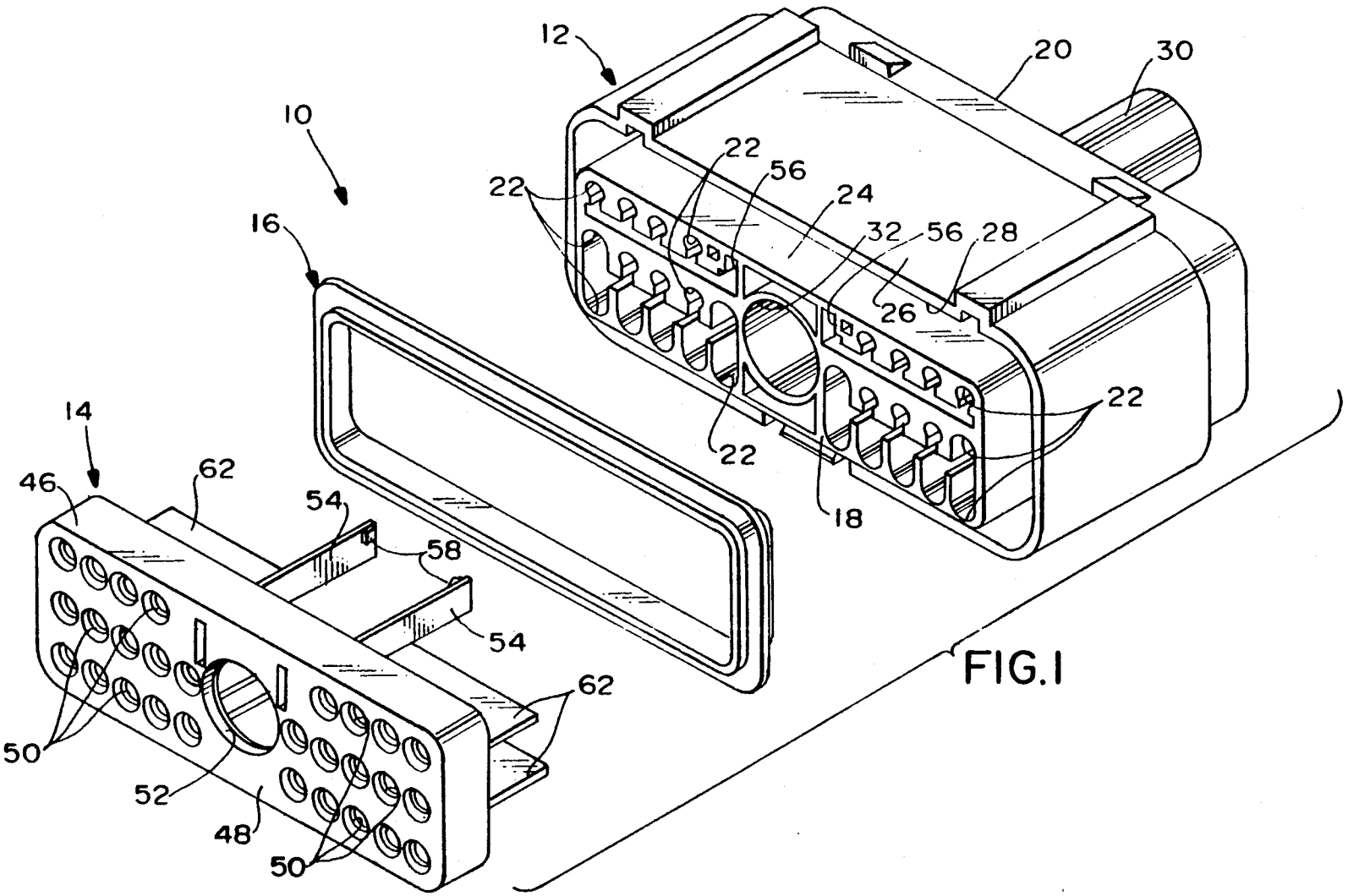
FIG. 1 is an exploded perspective view of an electrical connector embodying the concepts of the invention.

Referring to the drawings in greater detail, and first to FIG. 1, an electrical connector, generally designated 10, embodies the concepts of the invention and generally includes a dielectric housing, generally designated 12; a terminal locking and seal retaining member, generally designated 14; a seal, generally designated 16; and a plurality of terminals which are not visible in FIG. 1 but which will be described in relation to FIG. 2, the terminals being mounted within housing 12.

Before even proceeding with a more detailed description of the preferred embodiment, it is readily apparent from FIG. 1 that electrical connector 10 is very simple and, along with seal 16, includes only two basic components, namely housing 12 and the singular terminal locking and seal retaining member 14. As will be described below, member 14 performs a plurality of functions, including (a) defining the mating face of the electrical connector, (b) providing means for positively locking the terminals within the connector housing and (c) retaining the seal properly in position on the housing.

Figure 2:
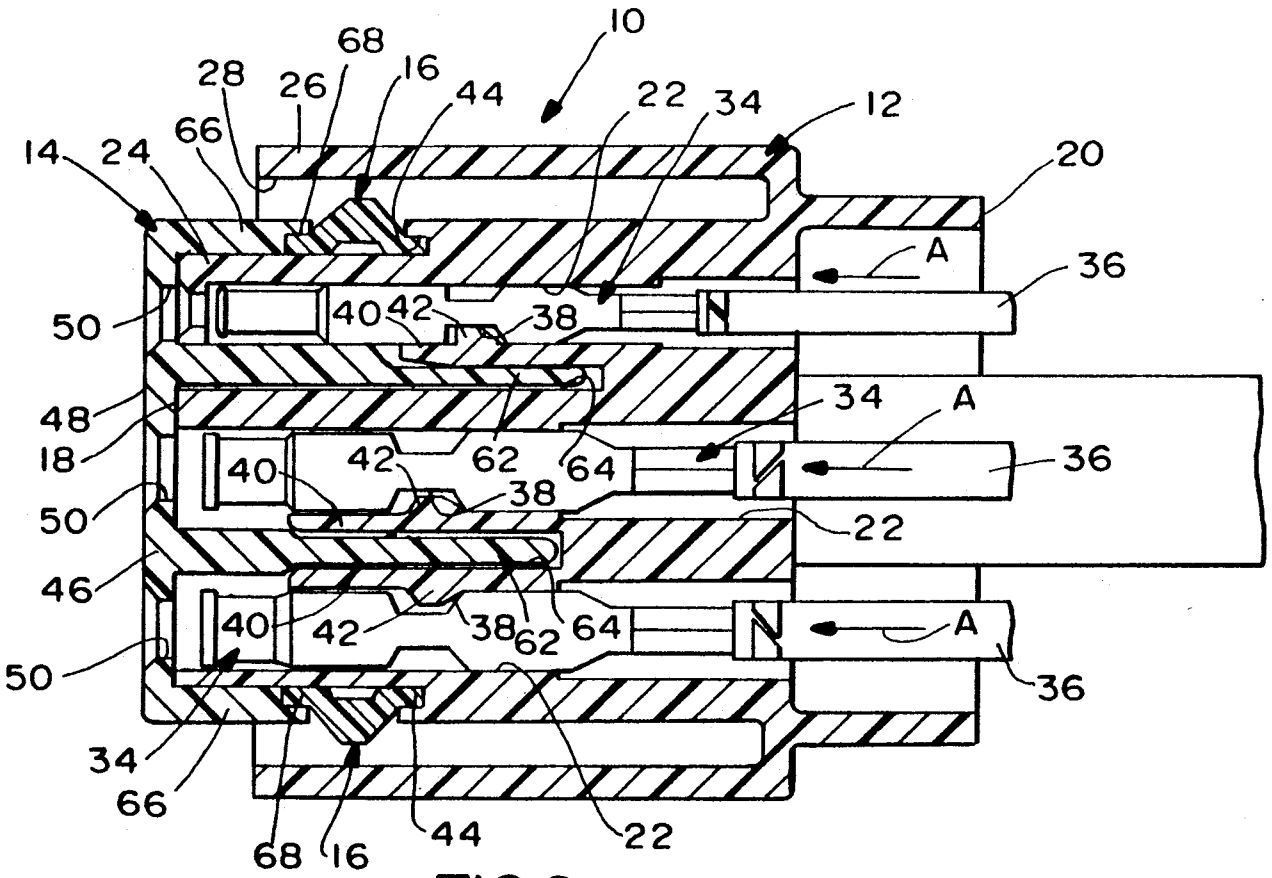
FIG. 2 is a vertical section, on an enlarged scale, through the connector in assembled condition.

More particularly, referring to FIG. 2 in conjunction with FIG. 1, housing 12 includes a front end 18 and a rear end 20, with a plurality of terminal-receiving passageways 22 extending therethrough. It can be seen that the passageways are arranged in three rows across the connector, the housing being elongated in the direction of the rows as best seen in FIG. 1. In essence, the passageways extend front-to-rear through a plug portion 24 of the housing, with a shroud portion 26 of the housing surrounding the plug portion and defining a peripheral recess 28 therebetween. The recess receives a receptacle portion of a complementary electrical connector (not shown) whereby plug portion 24 is inserted into the receptacle portion of the complementary connector and shroud portion 26 surrounds the complementary connector. The housing has a cylindrical boss 30 projecting from the rear thereof. The boss is in communication with a through hole 32 which extends entirely through the connector for receiving an appropriate fastening means, such as a bolt or the like.

A plurality of electrical terminals, generally designated 34, are positioned in passageways 22 of housing 12 as seen in FIG. 2. The terminals are terminated to electrical wires 36. The terminals are rear-loaded into passageways 22 in the direction of arrows "A". Each terminal has a recess 38 in a side thereof.

Generally, resilient latch means are provided by housing 12 for at least temporarily retaining terminals 34 within passages 22. More particularly, a plurality of resilient latch arms 40, one for each terminal, is provided with a projection 42 for engaging within a recess 38 of a respective terminal 34 when the terminal is properly positioned within its respective passageway 22. It can be seen that the rear sides of projections 42 are chamfered, and latch arms 40 are sufficiently resilient to provide an extremely low insertion force on terminals 34 when the terminals are rear-loaded into their respective passageways 22. The entire housing is unitarily molded of plastic or like material.

Seal 16 is shown in FIG. 1 to be a continuous, generally rectangular component. The seal is sized and shaped for embracing plug portion 24 of housing 12. The seal projects outwardly into recess 28 of the housing, as best seen in FIG. 2, whereby the seal will engage and establish a seal with the receptacle portion of the complementary connector which is inserted into recess 28 between plug portion 24 and shroud portion 26 of connector housing 12. As seen in FIG. 2, one edge of the seal is positioned within a recess 44 about the periphery of plug portion 24 of the housing.

As stated above, terminal locking and seal retaining member 14 performs a plurality of functions. First, the member includes a plate portion 46 which spans front end 18 of housing 12 and defines a mating face 48 of connector 10. Apertures 50 are provided through plate portion 46 in registry or alignment with passageways 22 in housing 12. An enlarged hole 52 also is provided for registry with hole 32 and boss 30 for receiving the appropriate fastener or bolt extending entirely through the connector. Member 14 preferably is unitarily molded of dielectric material, such as plastic or the like, and includes a pair of latch arms 54 projecting rearwardly therefrom and into a pair of passages 56 in housing 12. The latch arms have inwardly directed latch bosses 58 which latchingly engage behind surfaces (not shown) within housing 12 to hold member 14 on the housing. A pair of slots 60 are shown in FIG. 1, extending through plate portion 46. These slots simply are provided as core pin slots for use during molding of member 14.

Generally, member 14 includes lock means insertable into housing 12 for limiting movement of resilient latch arms 40 (FIG. 2) and thereby preventing terminals 34 from being withdrawn from the housing opposite the direction of arrows "A". More particularly, the lock means are provided by plates or arms 62 which are insertable into internal receptacles 64 of housing 12 as seen in FIG. 2. Receptacles 64 are located adjacent resilient latch arms 40 so that plates 62 limit or prevent movement of the latch arms and thereby maintain projections 42 in latching engagement within recesses 38 of terminals 34. Therefore, member 14, when positioned as shown in FIG. 2, prevents removal of terminals 34 from their passageways 22.

Lastly, member 14 provides still a further function of maintaining seal 16 in proper position about plug portion 24 of connector housing 12, i.e. in position within recess 44. More particularly, a peripheral flange 66 projects rearwardly about plug portion 24 into engagement with a forward edge 68 of seal 16, when member 14 is properly positioned as shown in FIG. 2. Therefore, it can be seen that seal 16 is sandwiched between recess 44 and flange 66 and is thereby maintained in position for wiping-sealing engagement with the receptacle portion of the complementary electrical connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector, comprising:

a dielectric housing having a plug portion surrounded by a shroud portion defining a peripheral recess therebetween, the plug portion having a front mating end and a rear end with a plurality of internal passageways extending therethrough, a plurality of resilient latch arms having projections projecting into the passageways, and receptacle means adjacent the resilient latch arms;

a plurality of terminals in the passageways and engageable by the projections of the latch arms;

a peripheral seal including a central section of a predetermined size, edges extending laterally from opposite sides of the central section, one of the edges located in a recess extending about the periphery of said plug portion;

a terminal locking and seal retaining member mountable to the front end of the housing and including a plate portion defining a mating face of the connector, lock means insertable into the receptacles in the housing for limiting movement of the resilient latch arms and thereby maintaining the projections in latching engagement with the terminals, and peripheral flange means extending substantially about the plug portion and having a recess extending about its periphery to accommodate the other edge of the seal, whereby both edges of the seal are maintained in their respective recesses.

2. An electrical connector set forth in claim 1, wherein the recess extending about the periphery of the plug portion is a groove in the plug portion of the housing.

3. An electrical connector as set forth in claim 1, wherein the recess extending about the periphery of the flange means comprises a groove defined by the flange means and the outside surface of the plug portion of the housing.

4. An electrical connector as set forth in claim 1, wherein the central portion of the seal extends into the peripheral recess between the plug portion an the shroud portion of the housing.

* * * * *